US007431018B2

(12) United States Patent
Tsujimoto

(10) Patent No.: US 7,431,018 B2
(45) Date of Patent: Oct. 7, 2008

(54) FUEL INJECTION SYSTEM MONITORING ABNORMAL PRESSURE IN INLET OF FUEL PUMP

(75) Inventor: Susumu Tsujimoto, Anjo (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/488,886

(22) Filed: Jul. 19, 2006

(65) Prior Publication Data

US 2007/0051340 A1 Mar. 8, 2007

(30) Foreign Application Priority Data

Jul. 19, 2005 (JP) ..... 2005-209144

(51) Int. Cl.
*F02M 63/00* (2006.01)

(52) U.S. Cl. ..... 123/446; 123/447; 123/458

(58) Field of Classification Search ..... 123/446, 123/447, 457–458, 494, 510–511
See application file for complete search history.

(56) References Cited

U.S. PATENT DOCUMENTS 4,719,889 A * 1/1988 Amann et al. ..... 123/447
4,884,545 A * 12/1989 Mathis ..... 123/447
5,313,924 A * 5/1994 Regueiro ..... 123/456
5,626,114 A 5/1997 Kushida et al.
6,024,064 A * 2/2000 Kato et al. ..... 123/179.17
6,142,120 A * 11/2000 Biester et al. ..... 123/456
6,817,344 B2 * 11/2004 Dandan et al. ..... 123/514
6,868,826 B1 * 3/2005 Oono ..... 123/339.1
6,889,666 B2 * 5/2005 Oono ..... 123/514
6,918,376 B2 * 7/2005 Oono et al. ..... 123/458

FOREIGN PATENT DOCUMENTS

JP 8-158971 6/1996

* cited by examiner

*Primary Examiner*—Thomas N Moulis
(74) *Attorney, Agent, or Firm*—Nixon & Vanderhye P.C.

(57) ABSTRACT

A fuel injection system is equipped with a high-pressure supply pump driven by an output of an internal combustion engine to supply fuel to an accumulator, a low-pressure supply pump driven by a power source other than the engine to suck the fuel from a fuel tank and supply the sucked fuel to the high-pressure supply pump, and a pressure regulator working to regulate the pressure of the fuel supplied from the low-pressure supply pump to the high-pressure supply pump. The system also includes an abnormal pressure detector working to monitor a preselected parameter that bears a correlation to the energy held by the fuel at an inlet of the high-pressure supply pump to detect whether a pressure of the fuel at the inlet of the high-pressure supply pump is in an abnormal level or not without monitoring it directly.

7 Claims, 3 Drawing Sheets

FUEL INJECTION SYSTEM MONITORING ABNORMAL PRESSURE IN INLET OF FUEL PUMP

CROSS REFERENCE TO RELATED DOCUMENT

The present application claims the benefit of Japanese Patent Application No. 2005-209144 filed on Jul. 19, 2005, the disclosure of which is incorporated herein by reference.

BACKGROUND OF THE INVENTION

1. Technical Field of the Invention

The present invention relates generally to a fuel injection system such as a common rail system (also called an accumulator fuel injection system) for automotive diesel engines which is designed to spray jets of high-pressure fuel supplied from an accumulator into cylinders of the engine through fuel injectors, and more particularly, to such a system designed to monitor an abnormal pressure of fuel sucked into a fuel pump for supplying the fuel to the accumulator.

2. Background Art

There are known accumulator fuel injection systems which are equipped with a common rail in which fuel is accumulated at a target pressure, as determined as a function of an operating condition of an internal combustion diesel engine, injectors working spray the fuel accumulated in the common rail into the engine, a fuel supply pump driven by output power of the engine to supply the fuel to the common rail, and a controller working to control operations of the injectors and the fuel supply pump.

There are also known accumulator fuel injection systems equipped with a low-pressure supply pump and a high-pressure supply pump. The low-pressure supply pump is installed in a fuel tank and driven by a power source other than the engine such as an electric motor to pump the fuel from the fuel tank. The pumped fuel is regulated in pressure by a pressure regulator and then sucked into the high-pressure supply pump.

In recent years, there has been an increasing need for the later type of fuel injection systems to detect an abnormal pressure of fuel at an inlet of the high-pressure supply pump in a simple manner in terms of improvement of the performance and durability thereof. For example, use of a pressure sensor has been proposed which is installed in a fuel flow path leading to an inlet of the high-pressure supply pump to measure the pressure of fuel sucked into the high-pressure supply pump directly.

The use of the pressure sensor, however, results in an increase in total production cost of the systems and a need for creasing a space for installation of the sensor.

For instance, Japanese Patent First Publication No. 8-158971 (U.S. Pat. No. 5,626,114) teaches techniques for regulating the pressure of fuel at an outlet of the high-pressure supply pump without use of an additional relief valve. Such techniques are suitable for regulating the pressure at the outlet of the high-pressure supply pump, but have a difficulty in regulating the pressure at the inlet of the high-pressure supply pump.

SUMMARY OF THE INVENTION

It is therefore a principal object of the invention to avoid the disadvantages of the prior art.

It is another object of the invention to provide a fuel injection system equipped with a high-pressure supply pump and a low-pressure supply pump which is designed to monitor an abnormal pressure of fuel at an inlet of the high-pressure supply pump indirectly in a simple manner.

According to one aspect of the invention, there is provided a fuel injection system which may be employed for automotive engines. The fuel injections system comprises: (a) an accumulator in which fuel is to be accumulated at a target pressure for injecting the fuel into an engine; (b) a high-pressure supply pump driven by an output of the engine to supply the fuel to the accumulator; (c) a low-pressure supply pump driven by a power source other than the engine to suck the fuel from a fuel tank and supply the sucked fuel to the high-pressure supply pump through a fuel flow path; (d) a pressure regulator disposed in the fuel flow path extending from the low-pressure supply pump to the high-pressure supply pump, the pressure regulator working to regulate a pressure of the fuel supplied from the low-pressure supply pump to the high-pressure supply pump; and (e) an abnormal pressure detector working to monitor a preselected parameter that bears a correlation to fuel-held energy that is energy held by the fuel at an inlet of the high-pressure supply pump to detect whether a pressure of the fuel at the inlet of the high-pressure supply pump is in an abnormal level or not.

The fuel-held energy is a function of the pressure of the fuel. The pressure of the fuel sucked into the high-pressure supply pump may, therefore, be known by monitoring the preselected parameter having the correlation to the fuel-held energy at the inlet of the high-pressure supply pump. The fuel-held energy is usually increased by application of energy to the fuel by means of the low-pressure supply pump (which will also be referred to as pumping energy below), but decreased with an increase in resistance of the fuel flow path to a flow of the fuel. Specifically, the fuel-held energy at the inlet of the high-pressure supply pump changes within a given range unless the flow resistance of a fuel flow path extending from the fuel tank to the high-pressure supply pump and the pumping energy change greatly.

The abnormal pressure of fuel at the inlet of the high-pressure supply pump may, therefore, be found by monitoring the above parameter. Specifically, the abnormal pressure of fuel at the inlet of the high-pressure supply pump may be found by selecting one of commands and values, as produced and measured by the fuel injection system which has the correlation to the fuel-held energy at the inlet of the high-pressure supply pump without measuring the pressure of fuel sucked into the high-pressure supply pump directly.

In the preferred mode of the invention, the fuel injection system further includes a suction control valve which is designed to have a variable open valve position and through which the high-pressure supply pump sucks the fuel fed from the low-pressure supply pump. The abnormal pressure detector works to monitor, as the preselected parameter, a pressure of the fuel accumulated in the accumulator to determine whether the pressure of the fuel at the inlet of the high-pressure supply pump is in the abnormal level or not when the engine is at rest, the pressure regulator is kept at a given valve position, and the low-pressure supply pump is operating.

When the engine is at rest, the pumping energy will be zero (0) in a fuel flow path extending from the high-pressure supply pump to the accumulator. Additionally, when the open valve position of the suction control valve is kept constant, the flow resistance of the fuel flow path extending from the high-pressure supply pump to the accumulator will be constant. Therefore, when the engine is at rest, and the open valve position of the suction control valve is kept constant, the pressure in the accumulator will increase as a function of the fuel-held energy at the inlet of the high-pressure supply pump. Specifically, when the engine is at rest, and the open valve position is kept constant, the rail pressure will have a positive correlation to the fuel-held energy at the inlet of the high-pressure supply pump and thus may be selected as the above parameter.

The abnormal pressure detector may alternatively work to monitor, as the preselected parameter, an open valve position of the suction control valve to determine whether the pressure of the fuel at the inlet of the high-pressure supply pump is in the abnormal level or not when the engine is in an idle mode of operation.

During the idling of the engine, the system works to regulates the open valve position of the suction control valve to bring an actual value of the pressure in the accumulator into agreement with a target value. Thus, when the fuel-held energy at the inlet of the high-pressure supply pump has changed, the system changes the open valve position for brining an actual value of the pressure in the accumulator into agreement with the target value. As the fuel-held energy (i.e., the pressure of fuel) at the inlet of the high-pressure supply pump increases, the system decreases the open valve position of the suction control valve. Alternatively, as the fuel-held energy at the inlet of the high-pressure supply pump decreases, the system increases the open valve position of the suction control valve. Consequently, when the engine is idling, the open valve position will have a negative correlation to the fuel-held energy at the inlet of the high-pressure supply pump and thus may be used as the parameter in monitoring the abnormal pressure at the inlet of the high-pressure supply pump.

According to another aspect of the invention, there is provided an abnormal pressure detecting method of detecting an abnormal pressure in a fuel injection system including (a) a accumulator in which fuel is to be accumulated at a target pressure for injecting the fuel into an engine, (b) a high-pressure supply pump driven by an output of the engine to supply the fuel to the accumulator, (c) a low-pressure supply pump driven by a power source other than the engine to suck the fuel from a fuel tank and supply the sucked fuel to the high-pressure supply pump through a fuel flow path, and (d) a pressure regulator disposed in the fuel flow path extending from the low-pressure supply pump to the high-pressure supply pump, the pressure regulator working to regulate a pressure of the fuel supplied from the low-pressure supply pump to the high-pressure supply pump. The method comprises: monitoring a preselected parameter that bears a correlation to fuel-held energy that is energy held by the fuel at an inlet of the high-pressure supply pump; and detecting whether a pressure of the fuel at the inlet of the high-pressure supply pump is in an abnormal level or not.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
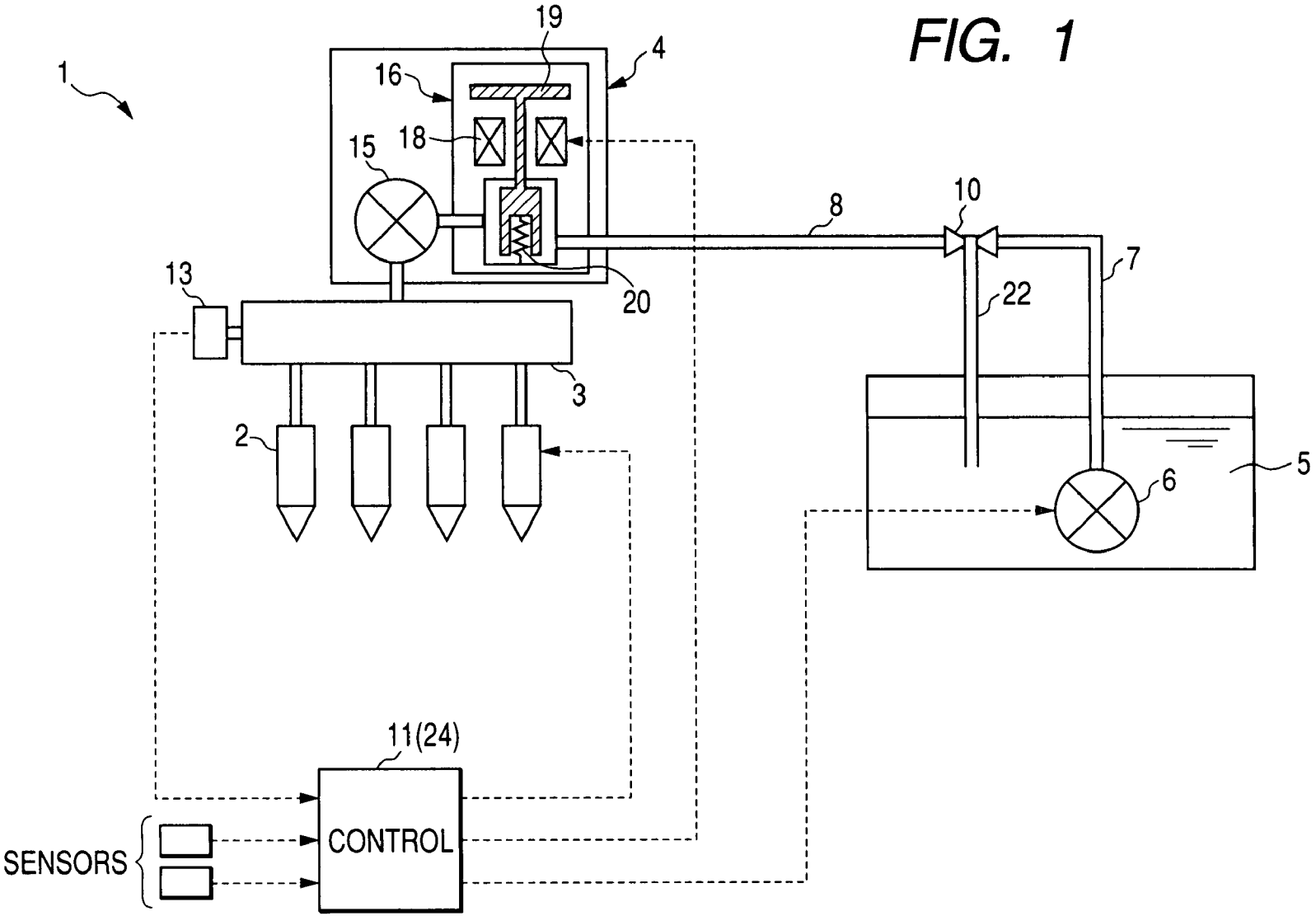
FIG. 1 is a block diagram which shows a fuel injection system according to the first embodiment of the invention.

Referring to the drawings, wherein like reference numbers refer to like parts in several views, particularly to FIG. 1, there is shown a fuel injection system 1 according to the first embodiment of the invention which is designed to inject fuel into cylinders of direct injection engines such as diesel engines.

The fuel injection system 1 consists essentially of injectors 2, one for each cylinder of the engine, a common rail 3, a high-pressure supply pump 4, a low-pressure supply pump 6, a pressure regulator 10, and a controller 11. The pressure regulator 10 is disposed between fuel flow paths 7 and 8 extending from the low-pressure supply pump 6 to the high-pressure supply pump 4. The low-pressure supply pump 6 is driven by a power source other than the engine to suck the fuel from a fuel tank 6 and supply it to the high-pressure supply pump 4 through the pressure regulator 10. The pressure regulator 10 regulates the pressure of the fuel discharged out of the low-pressure supply pump 6 to the high-pressure supply pump 4. The high-pressure supply pump 4 is driven by output of the engine to feed the fuel to the common rail 3. The common rail 3 serves as an accumulator to store the fuel fed from the high-pressure supply pump 4 at a given pressure and supply the fuel to the injectors 2. The controller 11 monitors outputs of sensors and controls operations of the low-pressure supply pump 6, the high-pressure supply pump 4, and the injectors 2.

Each of the injectors 2 includes a needle valve and a solenoid coil working as an actuator to move the needle valve to open or close spray holes. The opening or closing of the spray holes is achieved by energizing or deenergizing the solenoid coil to discharge or suck the fuel into or from a back chamber defined behind the needle valve.

The energization of the solenoid of each of the injectors 2 is achieved by a command signal outputted from the controller 11. Specifically, the controller 11 analyzes an operating condition of the engine such as the speed thereof to calculate an injection timing (i.e., the time the solenoid of the injector 2 should start to be energized to spray the fuel, which will be also referred to as a solenoid-energizing time below) and an injection period (i.e., the on-duration in which the solenoid is kept energized to continue to spray the fuel, which will also be referred to as a solenoid on-duration below). When the injection timing is reached, the controller 11 starts to supply electric power from an in-vehicle power supply to the solenoid of a corresponding one of the injectors 2 to inject a required quantity of fuel into the engine at a required time.

The common rail 3 serves as an accumulator to accumulate the high-pressure fuel, as fed from the high-pressure pump 4, and also as a distributor to distribute the high-pressure fuel to the injectors 2. The fuel injection system 1 also includes a rail pressure sensor 13 installed in an end of the common rail 3 which measures the pressure within the common rail 3 to provide a signal indicative thereof to the controller 11. The controller 11 converts the signal from the rail pressure sensor 13 into a digital form and uses it in producing various commands. The pressure in the common rail 3 will also be referred to as a rail pressure below.

The high-pressure supply pump 4 is equipped with a high-pressure pump 15 and a suction control valve (SCV) 16. The high-pressure pump 15 is driven by the output of the engine to pressurize and supply the fuel to the common rail 3. The suction control valve 16 is responsive to a control signal from the controller 11 to regulate the amount of fuel to be sucked into the high-pressure pump 15.

The high-pressure pump 15 is made up of a body in which a plurality of cylinders are formed, pistons disposed to be slidable within the cylinders, and a cam mechanism working to convert rotation of a cam shaft transmitted from a crankshaft of the engine into reciprocal motion of the pistons. The fuel is sucked into pressure chambers in sequence each of which is defined by an inner wall of one of the cylinders and an end wall of a corresponding one of the pistons, compressed, and discharged by the pistons to the common rail 3. Specifically, when the piston is moved to the bottom dead center by the action of the cam mechanism to increase the volume of the pressure chamber, it will cause the fuel to be sucked into the pressure chamber, while when the piston is moved to the top dead center by the action of the cam mechanism to decrease the volume of the pressure chamber, it will cause the fuel to be pressurized and discharged outside the pressure chamber.

The SCV 16 is of a normally open type which is equipped with a solenoid coil 18, an armature 19, and a spring 20. When energized, the solenoid coil 18 produces a magnetic attraction to move the armature 19 against pressure, as produced by the spring 20, in a direction in which the fuel flow path 8 extending from the pressure regulator 10 to the high-pressure pump 15 is closed. When the solenoid 18 is deenergized, the armature 19 is in a fully-opened valve position, the fuel flow path 8 is opened fully. The energization of the solenoid 18 is controlled by a duty cycle of a drive signal from the controller 11. Specifically, the SCV 16 is implemented by a variable open position type of solenoid valve designed to change an open position as a function of the degree of energization of the solenoid valve 18.

The open valve position (i.e., the degree of opening) of the SCV 16, which will also be referred to as an SCV open position below, is controlled as a function of a measured value of the rail pressure. Specifically, the controller 11 calculates a target rail pressure as a function of operating conditions of the engine and controls the SCV open position to bring an actual pressure in the common rail 3 into agreement with the target rail pressure. More specifically, the controller 11 calculates a difference between the measured value of the rail pressure and the target rail pressure or a ratio therebetween and determines a command value (i.e., a target value) of the SCV open position based on the difference between the measured value of the rail pressure and the target rail pressure or a ratio therebetween, a command value of amount of energization of the solenoid coil 18 required to achieve the command value of the SCV open position, and a duty cycle of a drive signal required to achieve the command value of amount of energization of the solenoid coil 18.

The controller 11 outputs the drive signal to the high-pressure pump 4 to energize the solenoid coil 18 at the determined duty cycle through the in-vehicle power supply to bring a measured value of the pressure in the common rail 3 into agreement with the target rail pressure.

The low-pressure pump 6 is equipped with a known impeller (also called runner) which is driven by an electric motor to suck the fuel out of the fuel tank 5 and feed it to the high-pressure supply pump 4. The electric motor is turned on upon start-up of the engine and energized constantly during running of the engine. In the absence of a failure in operation, the electric motor works to provide substantially constant torque to the impeller of the low-pressure supply pump 6, so that the low-pressure supply pump 6 give substantially constant energy to the fuel. Specifically, the low-pressure supply pump 6 works to discharge the fuel at a constant rate and a constant pressure during running of the engine as long as it is operating properly. In the following discussion, the energy applied by each of the high-pressure supply pump 4 and the low-pressure supply pump 6 to the fuel will be referred to as pumping energy below.

Even when the engine is at rest, the electric motor is designed to be permitted, as described later in detail, to operate in response to a command from the controller 11 for sensing an abnormal pressure of the fuel at an inlet of the high-pressure supply pump 4.

The pressure regulator 10 is, as described above, installed between the fuel flow paths 7 and 8 through which the fuel is fed from the low-pressure supply pump 6 to the high-pressure supply pump 4 and works to regulate the pressure of the fuel discharged from the low-pressure supply pump 6. The pressure regulator 10 also connects with a return flow path 22 to return part of the fuel discharged from the low-pressure supply pump 6 back to the fuel tank 5.

The pressure regulator 10 has a main flow path and an internal return flow path formed therein. The main flow path connects between the fuel flow paths 7 and 8. The internal return flow path extends from the main flow path and connects with the return flow path 22. The internal return flow path has disposed therein a check valve which works to block a back flow of the fuel from the return flow path 22 to the main flow path. The check valve is equipped with a spring which works to urge the check valve to close the internal return flow path.

When the pressure of the fuel flowing through the main flow path exceeds a set pressure of the spring, it opens the check valve to return the part of the fuel discharged from the low-pressure supply pump 6 to the fuel tank 5, thereby keeping the pressure of the fuel flowing out of the pressure regulator 10 at a constant level. The high-pressure supply pump 4, therefore, sucks the fuel fed at the constant pressure.

The controller 11 is equipped with an electronic control unit (ECU) and drivers. The ECU works to execute given control programs and produce command signals. The drivers are responsive to the command signals to supply electric power to the solenoid coil 18 of the high-pressure supply pump 4, the injectors 2, and the electric motor of the low-pressure supply pump 6.

The ECU is implemented by a typical microcomputer equipped with a CPU, ROMs, RAMs, an input circuit, and an output circuit. The ECU works to convert input signals from sensors (not shown) and the rail pressure sensor 13 into digital signals and use them in executing the control programs to produce command signals and monitoring malfunctions of devices, as described later.

The drivers of the controller 11 are equipped with switching devices which are activated in response to the command signals from the ECU to supply the electric power from the in-vehicle power supply to the injectors 2, the high-pressure supply pump 4, and the low-pressure supply pump 6.

The controller 11 works as an abnormal pressure detector 24 to monitor a preselected parameter bearing a correlation to the energy held by the fuel at the inlet of the high-pressure supply pump 4 to determine whether the pressure of fuel at the inlet of the high-pressure pump 4 is in an unusual level or not. In the following discussion, the energy held by the fuel will be referred to as fuel-held energy below.

Specifically, when the engine is at rest, the SCV open position is controlled to be brought into agreement with a given value, and the low-pressure supply pump 6 is operating, the abnormal pressure detector 24 monitors the rail pressure (i.e., the pressure of fuel within the common rail 3) to analyze the level of pressure of fuel sucked into the high-pressure supply pump 4.

Figure 2:
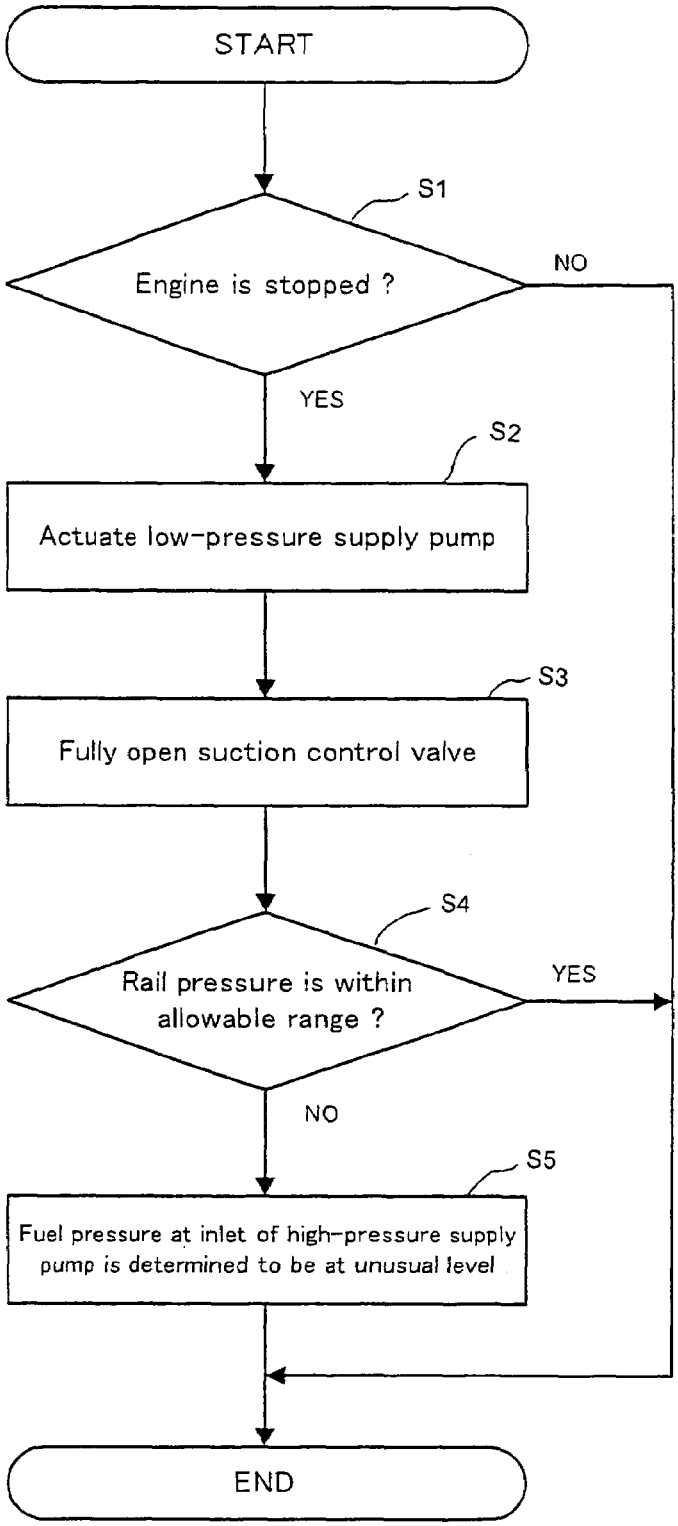
FIG. 2 is a flowchart of a program to be executed by the fuel injections system of FIG. 1 to monitor an abnormal pressure at an inlet of a high-pressure supply pump.

FIG. 2 is a flowchart of logical steps or program to be executed by the controller 11 (i.e., the abnormal pressure detector 24) to monitor the level of pressure of fuel at the inlet of the high-pressure supply pump 4. The program is initiated each time a travel distance of the vehicle or a total operation time of the engine reaches a preselected value.

After entering the program, the routine proceeds to step S1 wherein it is determined whether the engine is at rest or not. If a NO answer is obtained, then the routine terminates. Alternatively, if a YES answer is obtained, then the routine proceeds to step S2 wherein the low-pressure supply pump 6 is actuated. The routine proceeds to step S3 wherein the SCV 16 is fully opened to feed the fuel from the fuel tank 5 to the common rail 3 by means of only the pumping energy. The SCV 16 is, as described above, of a fully open type and kept in the full open valve position when deenergized.

The routine proceeds to step S4 wherein it is determined whether the rail pressure (i.e., the pressure of fuel within the common rail 3, as measured by the rail pressure sensor 13) is within a given allowable range or not. If a YES answer is obtained meaning that the rail pressure is changing or kept constant within the allowable range, then the routine terminates. Alternatively, if a NO answer is obtained, then the routine proceeds to step S5 wherein it is determined that the pressure of fuel at the inlet of the high-pressure supply pump 4 is in an unusual level. The routine then terminates.

It is found experimentally that the fact that the rail pressure is lower than the allowable range means that there is a high possibility of lack of supply of the fuel from the low-pressure supply pump 6, while the fact that the rail pressure is higher than the allowable range means that there is a high possibility of lack of regulating the pressure of fuel by means of the pressure regulator 10. It is, thus, possible to analyze whether the rail pressure is higher or lower than the allowable range to locate one of factors that results in the abnormal level of the rail pressure.

The controller 11, as described above, serves as the abnormal pressure detector 24 which works to monitor the parameter having the correlation to the fuel-held energy at the side of the inlet of the high-pressure supply pump 4 to detect the abnormal level of the pressure of fuel sucked into the high-pressure supply pump 4.

The fuel-held energy is equivalent to the pressure of fuel. The pressure of fuel sucked into the high-pressure supply pump 4 may, therefore, be found by measuring the parameter bearing the correlation to the fuel-held energy at the inlet of the high-pressure supply pump 4. The fuel-held energy is usually increased with an increase in the pumping energy, but decreased with an increase in resistance of a flow path to a flow of the fuel. Specifically, the fuel-held energy at the inlet of the high-pressure supply pump 4 changes within the allowable range unless the flow resistance of the fuel flow paths 7 and 8 and the flow resistance of the pressure regulator 10 and the pumping energy, as produced by the low-pressure supply pump 6, change greatly.

The abnormal pressure of fuel at the inlet of the high-pressure supply pump 4 may, therefore, be found by monitoring the above parameter. Specifically, the abnormal pressure of fuel at the inlet of the high-pressure supply pump 4 may be found by selecting one of the commands, as produced by the controller 11, and values, as measured by the controller 11, which has a correlation to the fuel-held energy at the inlet of the high-pressure supply pump 4 without measuring the pressure of fuel sucked into the high-pressure supply pump 4 directly.

The abnormal pressure detector 24 is designed to monitor the rail pressure, as the above parameter, when the engine is stopped, the SCV open position is placed in agreement with the given value, and the low-pressure supply pump 6 is operating. Specifically, when the engine is at rest, the pumping energy will be zero (0) in the flow path extending from the high-pressure supply pump 4 to the common rail 3. Additionally, when the SCV open position is kept constant, the flow resistance of the flow path extending from the high-pressure supply pump 4 to the common rail 3 will be constant. Therefore, when the engine is at rest, and the SCV open position is kept constant, the rail pressure will increase as a function of the fuel-held energy at the inlet of the high-pressure supply pump 4. Specifically, when the engine is at rest, and the SCV open position is kept constant, the rail pressure will have a positive correlation to the fuel-held energy at the inlet of the high-pressure supply pump 4 and thus may be selected as the above parameter.

The fuel injection system of the second embodiment of the invention which is designed to monitor an SCV position parameter that is a parameter changing as a function of the SCV open position (i.e., the open position of the SCV 16) during idle modes of engine operation to determine whether the pressure of fuel at the inlet of the high-pressure supply pump 4 is in an unusual level or not.

The SCV position parameter may be one of the command value (i.e., a target value) of the SCV open position, as calculated in the controller 11, the command value of amount of energization of the solenoid coil 18 required to achieve the command value of the SCV open position, a duty cycle of the drive signal required to achieve the command value of amount of energization of the solenoid coil 18, a difference between a measured value of the rail pressure and the target rail pressure and a ratio therebetween.

Figure 3:
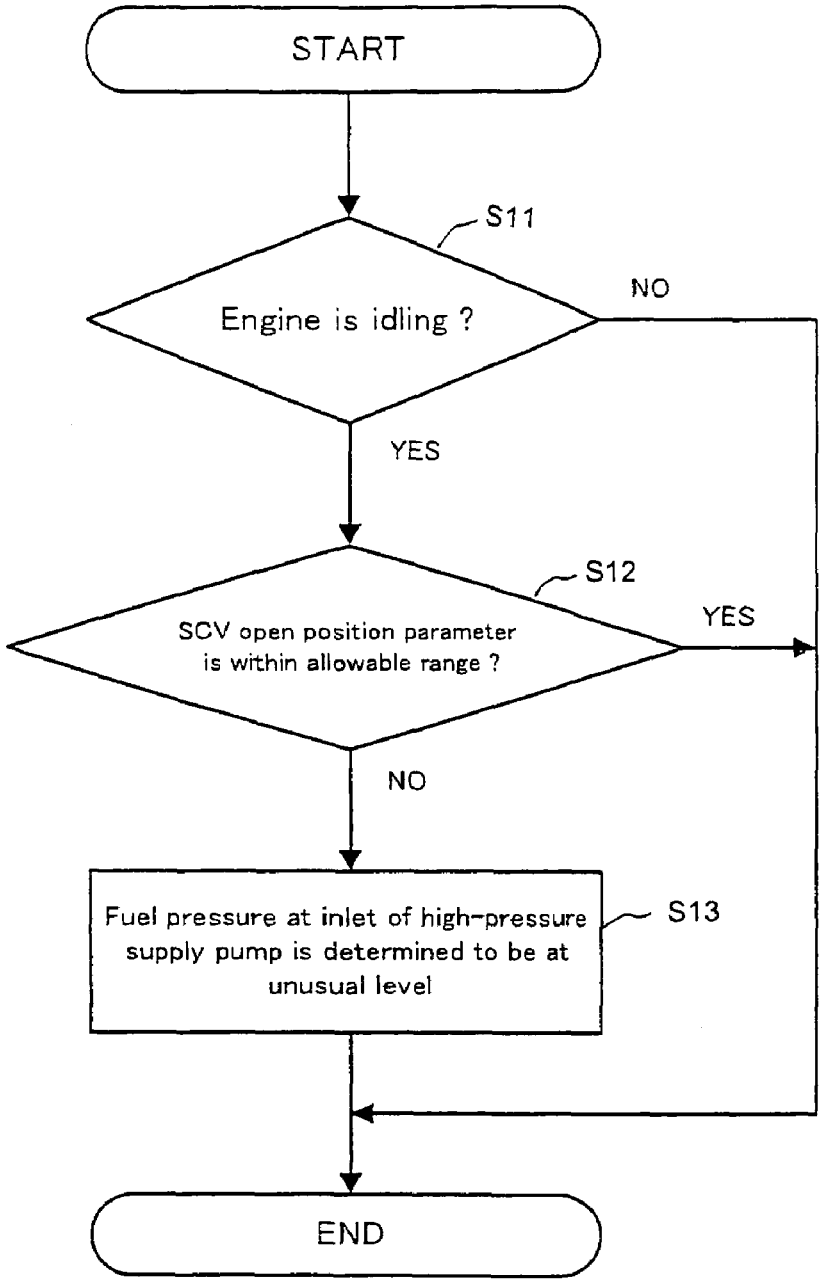
FIG. 3 is a flowchart of a program to be executed by a fuel injections system of the second embodiment to monitor an abnormal pressure at an inlet of a high-pressure supply pump.

FIG. 3 is a flowchart of logical steps or program to be executed by the controller 11 to monitor the level of pressure of fuel at the inlet of the high-pressure supply pump 4 in the second embodiment. The program is initiated each time a travel distance of the vehicle or a total operation time of the engine reaches a preselected value.

After entering the program, the routine proceeds to step S11 wherein it is determined whether the engine is idling or not. If a NO answer is obtained, then the routine terminates. Alternatively, if a YES answer is obtained, then the routine proceeds to step S12 wherein it is determined whether the SCV position parameter is within a given allowable range or not. If a YES answer is obtained meaning that the SCV position parameter is changing or kept constant within the allowable range, then the routine terminates. Alternatively, if a NO answer is obtained, then the routine proceeds to step S13 wherein it is determined that the pressure of fuel at the inlet of the high-pressure supply pump 4 is in an unusual level. The routine then terminates.

When the SCV position parameter represents the command value of the SCV open position, and it is smaller than the allowable range, it may be determined that the supply of the fuel from the low-pressure supply pump 6 is lacking. Alternatively, when the command value of the SCV open position is greater than the allowable range means, it may be determined that the regulation of the pressure of fuel by means of the pressure regulator 10 is lacking. It is, thus, possible to analyze whether the SCV open position is greater or smaller than the allowable range to locate one of factors that results in the abnormal level of the rail pressure.

The controller 11, as described above, serves as the abnormal pressure detector 24 which works to monitor the SCV position parameter that is a parameter changing as a function of the SCV open position during idling of the engine to determine whether the pressure of fuel at the inlet of the high-pressure supply pump 4 is in an unusual level or not.

During the idling of the engine, the controller 11 regulates the SCV open position to bring an actual value of the rail pressure into agreement with a target value. Thus, when the fuel-held energy at the side of the inlet of the high-pressure supply pump 4 has changed, the controller 11 works to change the SCV open position for brining an actual value of the rail pressure into agreement with the target value. Specifically, as the fuel-held energy (i.e., the pressure of fuel) at the inlet of the high-pressure supply pump 4 increases, the controller 11 decreases the SCV open position of the SCV 16. Alternatively, as the fuel-held energy at the inlet of the high-pressure supply pump 4 decreases, the controller 11 increases the SCV open position. Consequently, when the engine is idling, the SCV open position will have a negative correlation to the fuel-held energy at the inlet of the high-pressure supply pump 4 and thus may be used as the parameter in monitoring the abnormal pressure at the inlet of the high-pressure supply pump 4.

The controller 11 of the first embodiment is, as described above, designed to use the rail pressure as the parameter representing the abnormal pressure at the inlet of the high-pressure supply pump 4 when the engine is at rest, the SCV open position is kept constant, and the low-pressure supply pump 6 is operating. The controller 11 of the second embodiment is designed to use the SCV position parameter as the parameter representing the abnormal pressure at the inlet of the high-pressure supply pump 4 when the engine is idling. The controller 11, however, may be designed to use the SCV position parameter when the engine is in an operation mode other than the idle mode, and the rail pressure is controlled to a given target level.

The SCV 16 may alternatively be of a normally closed type in which the SCV 16 is fully closed when the solenoid coil 18 is deenergized. In this case, the controller 11 of the first embodiment needs to open the SCV 16 to a certain degree to supply the fuel to the common rail 3 when monitoring the pressure at the inlet of the high-pressure fuel pump 4.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A fuel injection system for an engine comprising:

an accumulator in which fuel is to be accumulated at a target pressure for injecting the fuel into an engine;

a high-pressure supply pump driven by an output of the engine to supply the fuel to said accumulator;

a low-pressure supply pump driven by a power source other than the engine to suck the fuel from a fuel tank and supply the sucked fuel to said high-pressure supply pump through a fuel flow path;

a pressure regulator disposed in the fuel flow path extending from said low-pressure supply pump to said high-pressure supply pump, said pressure regulator working to regulate a pressure of the fuel supplied from said low-pressure supply pump to said high-pressure supply pump; and an abnormal pressure detector working to monitor a preselected parameter that bears a correlation to fuel-held energy that is energy held by the fuel at an inlet of said high-pressure supply pump to detect whether a pressure of the fuel at the inlet of said high-pressure supply pump is in an abnormal level or not.

2. A fuel injection system as set forth in claim 1, further comprising a suction control valve which is designed to have a variable open valve position and through which said high-pressure supply pump sucks the fuel fed from the low-pressure supply pump, and wherein said abnormal pressure detector works to monitor, as the preselected parameter, a pressure of the fuel accumulated in said accumulator to determine whether the pressure of the fuel at the inlet of said high-pressure supply pump is in the abnormal level or not when the engine is at rest, said pressure regulator is kept at a given valve position, and said low-pressure supply pump is operating.

3. A fuel injection system as set forth in claim 1, further comprising a suction control valve which is designed to have a variable open valve position and through which said high-pressure supply pump sucks the fuel fed from the low-pressure supply pump, and wherein said abnormal pressure detector works to monitor, as the preselected parameter, an open valve position of said suction control valve to determine whether the pressure of the fuel at the inlet of said high-pressure supply pump is in the abnormal level or not when the engine is in an idle mode of operation.

4. An abnormal pressure detecting method of detecting an abnormal pressure in a fuel injection system including (a) a accumulator in which fuel is to be accumulated at a target pressure for injecting the fuel into an engine, (b) a high-pressure supply pump driven by an output of the engine to supply the fuel to said accumulator, (c) a low-pressure supply pump driven by a power source other than the engine to suck the fuel from a fuel tank and supply the sucked fuel to said high-pressure supply pump through a fuel flow path, and (d) a pressure regulator disposed in the fuel flow path extending from said low-pressure supply pump to said high-pressure supply pump, said pressure regulator working to regulate a pressure of the fuel supplied from said low-pressure supply pump to said high-pressure supply pump, comprising:

monitoring a preselected parameter that bears a correlation to fuel-held energy that is energy held by the fuel at an inlet of said high-pressure supply pump; and detecting whether a pressure of the fuel at the inlet of said high-pressure supply pump is in an abnormal level or not based on the monitored preselected parameter.

5. A method as set forth in claim 4, wherein the monitored preselected parameter is a pressure of the fuel accumulated in said accumulator to determine whether the pressure of the fuel at the inlet of said high-pressure supply pump is in the abnormal level or not when the engine is at rest, said pressure regulator includes a valve which is kept at a given valve position, and said low pressure supply pump is operating.

6. A method as set forth in claim 5, further comprising arranging a suction control valve, which is designed to have a variable open valve position and through which said high-pressure supply pump sucks the fuel fed from the low-pressure supply pump, in the fuel flow path.

7. A method as set forth in claim 4, further comprising:

arranging a suction control valve, which is designed to have a variable open valve position and through which said high-pressure supply pump sucks the fuel fed from the low-pressure supply pump, in the fuel flow path, wherein the preselected parameter is an open valve position of said suction control valve so that the pressure of the fuel at the inlet of the high-pressure supply pump is in the abnormal level or not is determined when the engine is in an idle mode of operation.

* * * * *